US008896237B2

(12) United States Patent
Vankan et al.

(10) Patent No.: US 8,896,237 B2
(45) Date of Patent: Nov. 25, 2014

(54) METHOD AND DEVICE FOR DRIVING A GAS DISCHARGE LAMP

(75) Inventors: Peter Johannes Wilhelmus Vankan, Eindhoven (NL); Wai Pang Chow, Eindhoven (NL); Johannes Theodorus Jacobus Van Haastrecht, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 95 days.

(21) Appl. No.: 13/635,032

(22) PCT Filed: Mar. 1, 2011

(86) PCT No.: PCT/IB2011/050854

§ 371 (c)(1),
(2), (4) Date: Sep. 14, 2012

(87) PCT Pub. No.: WO2011/114248

PCT Pub. Date: Sep. 22, 2011

(65) Prior Publication Data

US 2013/0009562 A1 Jan. 10, 2013

(30) Foreign Application Priority Data

Mar. 17, 2010 (EP) ..... 10156763
Jul. 22, 2010 (EP) ..... 10170383

(51) Int. Cl.

| | |
|---|---|
| ***H05B 37/02*** | (2006.01) |
| ***H05B 41/392*** | (2006.01) |
| ***H05B 41/295*** | (2006.01) |
| ***H05B 41/04*** | (2006.01) |

(52) U.S. Cl.

CPC ..... *H05B 41/295* (2013.01); *H05B 41/3924* (2013.01); *H05B 41/392* (2013.01); *H05B 41/046* (2013.01)

USPC ..... 315/360; 315/307; 315/308; 315/361

(58) Field of Classification Search

USPC ..... 315/360, 177, 200 R, 205, 209 R, 291, 315/294, 297, 299, 307, 308, 326, 361, 362

See application file for complete search history.

(56) References Cited

U.S. PATENT DOCUMENTS

| | | | |
|---|---|---|---|
| 5,477,109 | A | 12/1995 | Chermin |
| 5,811,940 | A | 9/1998 | Nutzel |
| 2005/0253535 | A1 | 11/2005 | Van Den Hoek |

FOREIGN PATENT DOCUMENTS

| | | | |
|---|---|---|---|
| GB | 2155258 | A | 9/1985 |
| WO | 2007004190 | A2 | 1/2007 |
| WO | 2009066223 | A2 | 5/2009 |
| WO | 2009101552 | A1 | 8/2009 |

*Primary Examiner* — Douglas W Owens
*Assistant Examiner* — Jianzi Chen

(57) ABSTRACT

A method for operating a fluorescent lamp (5) having a nominal power (WLa) and stabilized with an EM ballast (B) comprises the steps of during normal operation, short-circuiting the lamp during a closing time interval (CTI) during each current period in order to operate the lamp at a reduced power. The method comprises the step of detecting whether the lamp is stabilized by means of an inductive ballast or by means of a capacitive ballast. If it is found that the ballast is capacitive, the timing of the closing time interval (CTI) is set such that the closing time interval (CTI) has a first closing time segment (CTS1) immediately before a zero-crossing of the current, having a first duration (Δ1) higher than zero, and a second closing time segment (CTS2) immediately after said zero-crossing of the current, having a second duration (Δ2) higher than zero.

6 Claims, 8 Drawing Sheets

METHOD AND DEVICE FOR DRIVING A GAS DISCHARGE LAMP

FIELD OF THE INVENTION

The present invention relates in general to control circuitry for a gas discharge lamp, particularly a fluorescent lamp; particularly, the present invention relates to a starter device.

BACKGROUND OF THE INVENTION

In general, a gas discharge lamp comprises a cylindrical transparent container, indicated hereinafter as "tube", with two electrodes at the opposite ends of the tube and a special gas filling (typically comprising mercury vapour) in the tube. The lamp is operated by applying a lamp voltage to the electrodes, resulting in a discharge current in the lamp, which current results in UV light being generated. To produce visible light, the inner surface of the tube, typically glass, is coated with a fluorescent material that converts UV light into visible wavelength. Since gas discharge lamps are known per se, a further explanation is not needed; by way of example, the well-known TL lamp is mentioned.

Although lamps may be operated with different supply voltages, the lamps are typically intended to be supplied with mains voltage. In Europe, mains voltage has a typical rating of 230 V AC at 50 Hz, but in different countries the circumstances may be different. A gas discharge lamp cannot be connected to the mains directly, in view of the fact that a gas discharge lamp has a negative impedance characteristic. Therefore, a gas discharge lamp is always provided with a ballast circuit connected in series with the lamp, the ballast circuit at least comprising an inductor. On the basis of the impedance characteristics of the ballast, a distinction can be made between two types of ballast circuits. A first type of ballast circuit has an inductive impedance; such ballast circuit will also be indicated as an "L-ballast", and typically consists of an inductor alone. A second type of ballast circuit has a capacitive impedance; such ballast circuit will also be indicated as a "C-ballast", and typically consists of a series arrangement of an inductor and a capacitor, wherein the impedance of the capacitor (at the mains frequency) is higher than, typically twice as high as, the impedance of the inductor. Many armatures accommodate two lamps, one being provided with an L-ballast and the other being provided with a C-ballast; in such case, which will be indicated as a duo armature, the armature as a whole may exhibit a resistive impedance such that the current provided by the mains is in phase with the mains voltage.

It is noted that, in theory, it is possible to vary the inductance of the inductor in an L-ballast or a C-ballast and/or to vary the capacitance of the capacitor in a C-ballast. However, for standard lamp types also the inductor and capacitor typically have standard values. For instance, in a 36 W TL-lamp, the inductor has a standard value of 0.8 H and the capacitor has a standard value of 3.4 μF.

A particular situation exists when the lamp is OFF and needs to be started. Because of the lamp being OFF, it provides a high impedance at the mains frequency, and the mains voltage is insufficient to cause ignition of the lamp. To solve this problem, the lamp is conventionally equipped with a starter element arranged in parallel to the lamp. This starter element is basically a switch that is closed (conductive) when the lamp is OFF. When the lamp is to be started, the closed starter switch short-circuits the lamp, and the impedance of the lamp circuit is determined mainly by the impedance of the ballast. As a result, a preheat current flows in the lamp circuit, heating the electrodes. After a predetermined preheat time, the starter switch opens, which causes a voltage peak over the heated lamp electrodes sufficient to obtain a discharge to ignite the lamp.

In a more recent development, said conventional starter switch, also indicated as glow starter, has been replaced by an electronic switch.

SUMMARY OF THE INVENTION

While the standard TL lamp is commonly known, recent developments have resulted (and future developments will result) in new types of TL lamps, pin-compatible with the "older" lamps, but offering a better color rendering and a higher light output. In many cases, however, consumers are not necessarily interested in obtaining a higher light output. Then, with the new types of lamps, it is possible to reduce the light output so that the light output is comparable to the "older" lamps, offering a reduction in power consumption while nonetheless offering a better color rendering. Reducing the light output and the power consumption can be done by dimming the lamp. Dimming can be done by using a mains dimmer, but adapting an existing infrastructure by mounting mains dimmers is relatively costly.

The invention offers a much easier and cheaper solution by using such electronic switch as mentioned, implemented as a switch unit having terminals identical to the terminals of the glow starter so as to be able to retrofit such electronic switch unit in an existing armature, and adapted for dimming the lamp: during each half-period of the current, the electronic switch briefly short-circuits the lamp, so that the current does not flow through the lamp any more.

Such dimming operation is known per se; in the prior art, opening the switch again coincides with a zero-crossing of the current. This known method of dimming works well in the case of inductive ballasts; the system current is reduced, and thus the ballast dissipation is reduced. However, if this known method is used in the case of capacitive ballasts, an overall increase in the average system current magnitude results and thus an increase in ballast dissipation. Consequently, the ballast temperature may rise above the norm level, which might lead to potentially unsafe situations. Further, the energy reduction of the system as a whole is reduced, and the ballast life is shortened. Further, it is found that an audible hum is produced by the ballast, the loudness depending on the ballast type. Further, it is found that differences occur between the light output of the capacitive ballast as compared to the light output of the inductive ballast, which is undesirable in a duo luminaire comprising both a lamp with an inductive ballast and a lamp with a capacitive ballast. It is true that such differences can be reduced by adapting the dim level of the capacitively ballasted lamp, but this would only increase the other problems.

An object of the present invention is to overcome the above problems.

According to the invention, control of the electronic switch is made dependent on the ballast type. In the case of a capacitive ballast, the time of opening the switch again does not coincide with a zero-crossing of the current but is shifted to a small time distance later than the this zero-crossing. As a result, the overall system current is reduced and thus the power dissipation in the ballast is reduced, which in turn is favorable in many aspects. Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1A:
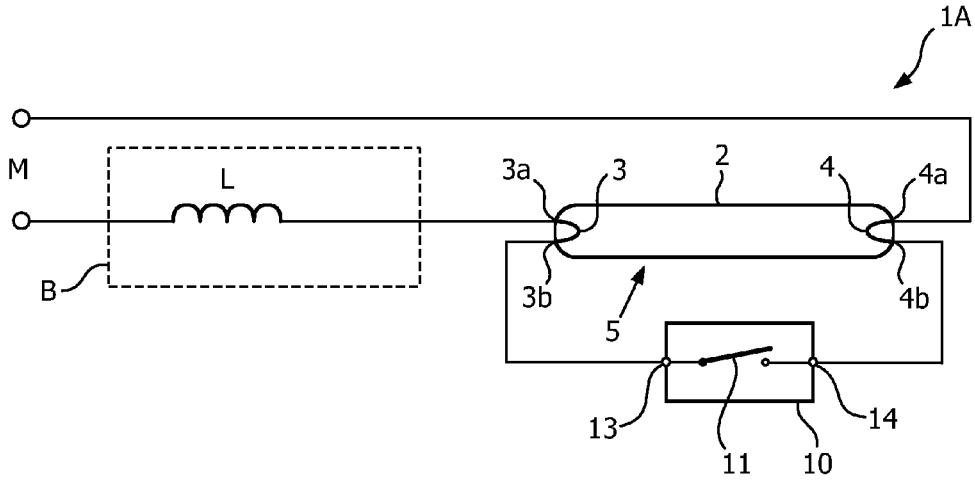
FIGS. 1A-1B are block diagrams schematically showing an illumination system.
Figure 1B:
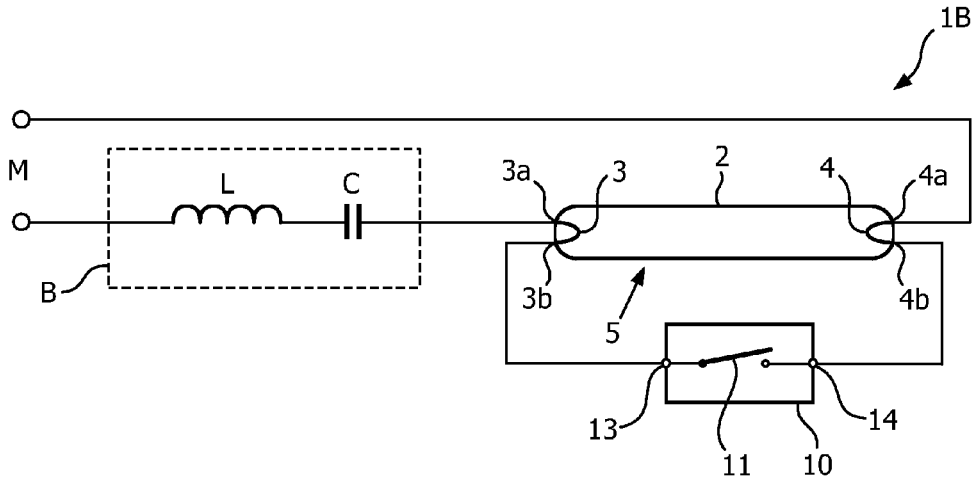

FIGS. 1A-1B are block diagrams schematically showing an illumination system 1A, 1B including a gas discharge lamp 5. The lamp 5 comprises a tube 2 with electrodes 3, 4 at opposite ends, and has nomimal power rating Wla, which means the power for which the lamp is designed to be operated at; typically, the value of Wla is specified on the lamp itself and/or on its packaging. Each electrode 3, 4 is implemented as a spiral filament with first terminals 3*a*, 4*a* and second terminals 3*b*, 4*b*. The first terminal 3*a* of the first electrode 3 is connected to mains M with a ballast B connected in series. The first terminal 4*a* of the second electrode 4 is connected to another lead of mains M. In the case of FIG. 1A, the ballast B consists of an inductor L; in the case of FIG. 1B, the ballast B consists of an inductor L in series with a capacitor C. The ballast of FIG. 1A will be indicated as an inductive ballast. In the design of FIG. 1B, the overall behavior will be capacitive (the impedance of the capacitor, at operating frequencies, is higher than the impedance of the inductor), for which reason the ballast of FIG. 1B will be indicated as a capacitive ballast. In a duo embodiment (not shown), there will be two lamps of identical type, the one having an inductive ballast while the other has a capacitive ballast, these two ballasts matching each other so that the overall impedance is resistive. In such duo embodiment, it is important that the light outputs of both lamps are almost identical to each other.

A starter device 10 is connected between the second terminal 3*b* of the first electrode 3 and the second terminal 4*b* of the second electrode 4. The starter device 10 has two terminals 13, 14, connected to the second terminals 3*b*, 4*b* of the lamp electrodes 3, 4, respectively. In the FIGS. 1A and 1B, for sake of simplicity, the starter device 10 is simply shown as comprising only a mechanical switch 11 connected between said terminals 13, 14. Such embodiment would correspond to the conventional bimetal switch.

Figure 2:
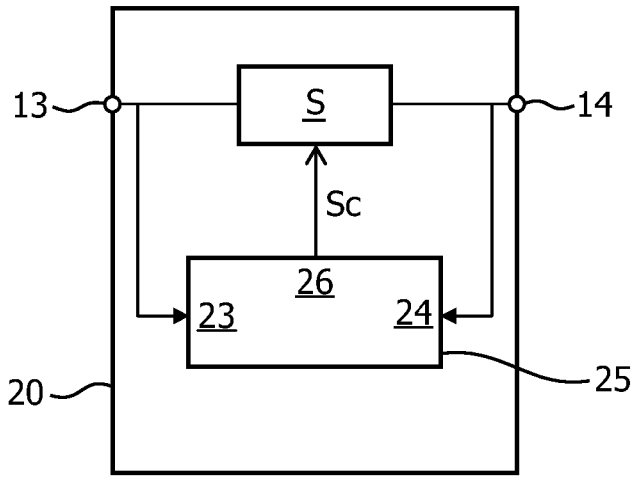
FIG. 2 is a block diagram schematically showing a starter device.

FIG. 2 is a block diagram schematically showing an adaptive starter device 20 according to the present invention, capable of being used as replacing an existing mechanical starter. As compared to the conventional starter device 10 of FIG. 1A-1B, the mechanical switch 11 has been replaced by a controllable switch S, while the adaptive starter device 20 further comprises a control circuit 25 for controlling the controllable switch S. The control circuit 25 has two input terminals 23, 24 coupled to the said terminals 13, 14 of the adaptive starter device 20, respectively, and a control output terminal 26 coupled to a control input of the controllable switch S.

It is noted that the design of the controllable switch S is not essential for implementing the present invention, as should be clear to a person skilled in the art. For instance, the switch S may be implemented as a MOSFET, a thyristor, etc.

The control circuit 25 is capable of operating in a starting mode for starting the lamp, in a normal mode, and in a dim mode. In the normal mode, the switch S is continuously open, i.e. non-conductive, and all current flows through the lamp. In the dim mode, the control circuit 25 is designed to generate at its control output terminal 26 a control signal Sc for the controllable switch S, in such a way that, during each half-period of the current, the switch S is briefly closed such as to short-circuit the lamp, so that the current does not flow through the lamp any more but through the switch.

Figure 4:
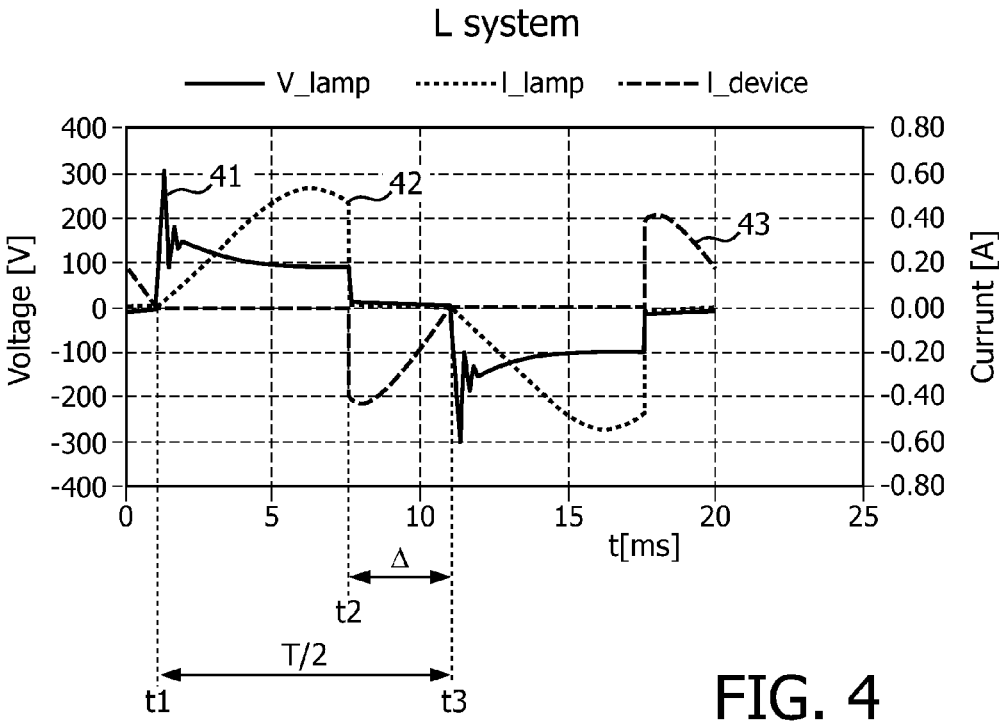
FIG. 4 is a graph illustrating the operation of a prior art electronic switch in dim mode.

FIG. 4 is a graph illustrating the operation of the control circuit 25 according to prior art. Curve 41 illustrates the lamp voltage (in Volt, lefthand vertical axis), curve 42 illustrates the lamp current, and curve 43 illustrates the current through the switch S (in Ampere, righthand vertical axis). A zero-crossing of the current is indicated at time t1: at that moment, the switch S is open, the lamp voltage (curve 41) reaches a stable level independent of current level, and the lamp current (curve 42) follows a substantially sine-shaped curve. At time t2, the switch S is closed, causing the lamp voltage and lamp current to drop to zero almost instantaneously, and causing the current to continue flowing through the switch (curve 43; note that the dissipation is low caused by the fact that the voltage drop over the starter switch S is low). For sake of clarity, the current direction for the switch current is shown opposite to the current direction for the lamp current. At time t3, the next zero-crossing of the current occurs, the switch S is opened again, and the above procedure repeats itself.

Taking the lamp current as defining a period with a phase between zero and $2\pi$, the phase of time t1 coincides with phase angle $\phi 1=0$, the phase of closing the switch at time t2 coincides with a phase angle $\phi 2$, and the phase of opening the switch at time t3 coincides with a phase angle $\phi 3=180°$. In a mains system where the mains frequency is equal to 50 Hz, as shown in the figure, the time distance $T/2=t3-t1$ between two zero-crossings is equal to 10 ms, with T indicating the current period of 20 ms. The short-circuit time $\Delta=t3-t2$ is typically varied in the range from 0.5 ms to 4 ms.

According to the present invention, the control circuit 25 is designed to analyze the signals received at its input terminals 13, 14, to determine whether the ballast B that is currently connected in series with the lamp is inductive or capacitive, and, at least in dim mode, to adapt its control signal Sc according to the outcome of the analysis. If it is found that the ballast B is inductive, the control method described above with reference to FIG. 4 is applied. If it is found that the ballast B is capacitive, the switch S is controlled according to a different control method, as will be described below with reference to FIG. 5.

It is noted that methods for assessing the type of ballast are known per se. One possible method will be described with reference to FIG. 3.

Figure 3:
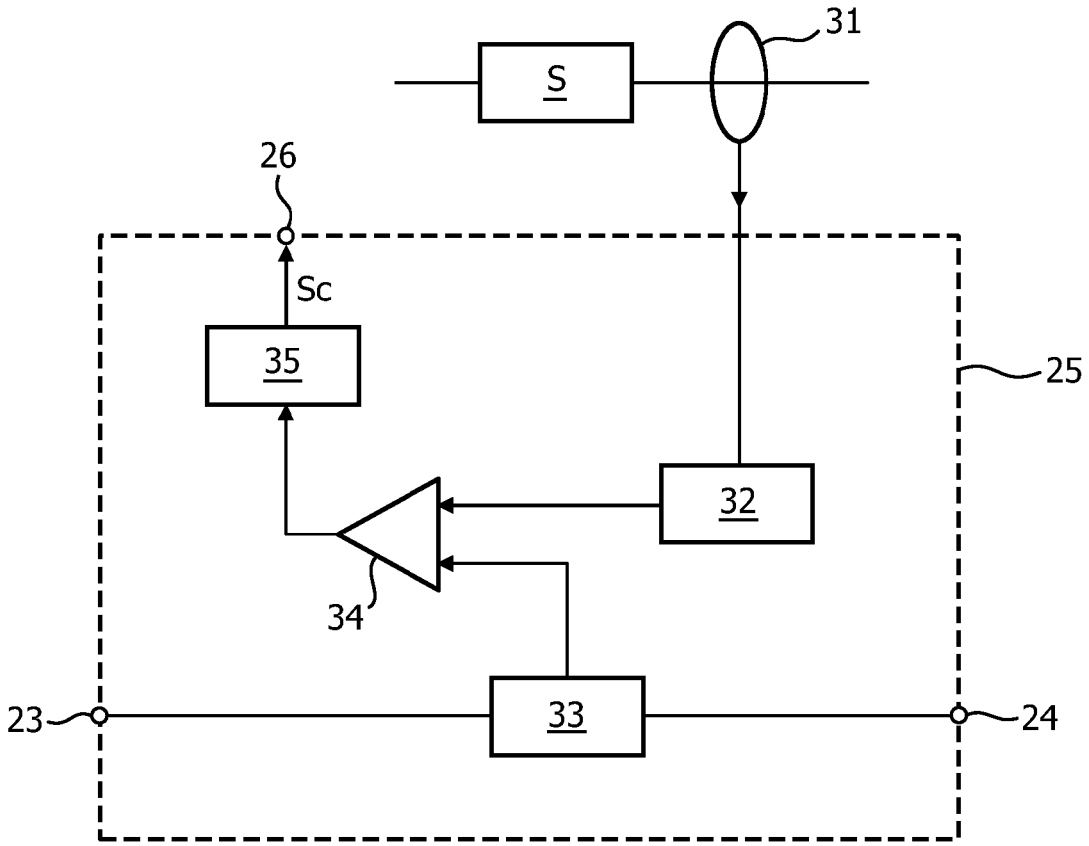
FIG. 3 is a block diagram schematically showing a controller of a starter device.

FIG. 3 is a block diagram illustrating a possible embodiment of the control circuit 25 in more detail. In this embodiment, the starter device 20 comprises a current sensor 31 for sensing the current in the switch S. A first timing circuit 32 receives the current sensor output signal and provides a first timing output signal indicating the timing of the zero-crossings of the current.

The starter device 20 further comprises a PLL (phase-locked loop) circuit 33. The PLL circuit 33 receives the mains voltage (or a signal derived therefrom) for synchronization with the mains voltage. The PLL circuit 33 provides a second timing output signal indicating the timing of the zero-crossings of the voltage. During preheating of the lamp electrodes, the voltage over the switch is substantially zero and the PLL circuit 33 does not receive a voltage signal any more, but the PLL circuit 33 continues to provide its second timing output signal, as should be clear to a person skilled in the art.

A timing comparator 34 receives the first timing output signal from the first circuit 32 and the second timing output signal from the PLL circuit 33. The timing comparator 34 is adapted to measure the timing delay Δt between the first and second timing output signals, to compare this delay with a predetermined delay threshold $\Delta_{TH}$, and to provide an output signal having a first or second value depending on the timing delay Δt being larger or smaller than the threshold $\Delta_{TH}$. A switch controller 35 receives the output signal from the timing comparator 34, and generates the switch control signal Sc having a characteristic suitable for cooperation with a capacitive or inductive ballast, depending on the output signal from the timing comparator 34 having the first or second value.

It is noted that the switch controller 35 and the timing comparator 34 may be integrated as one unit Likewise, the timing comparator 34 and the first circuit 32 may be integrated.

Figure 5:
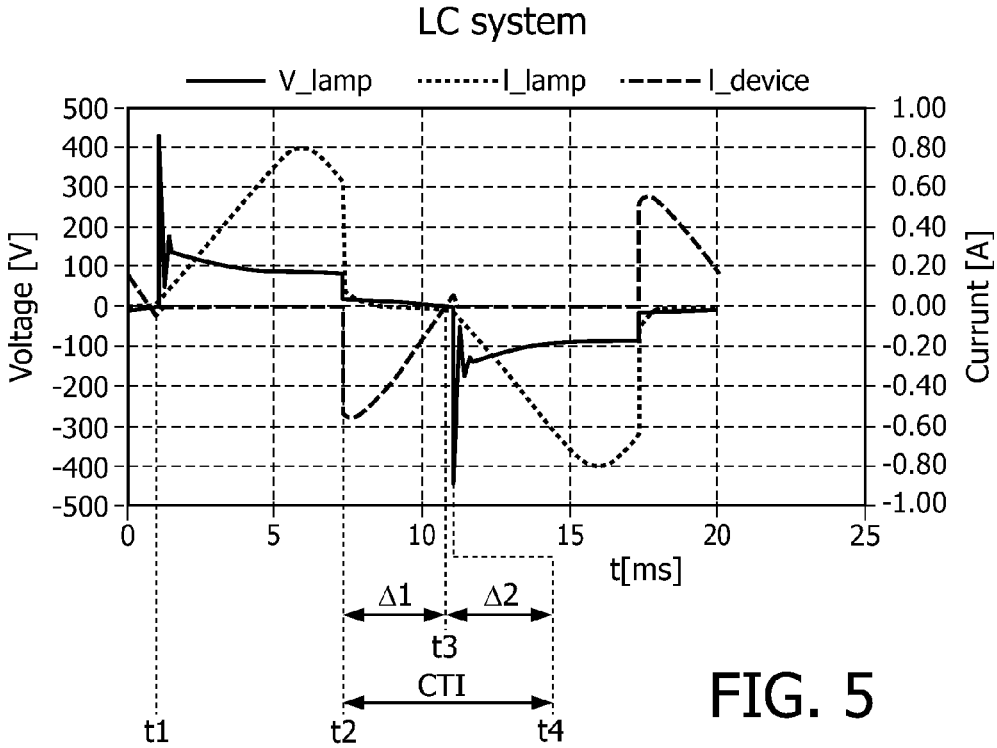
FIG. 5 is a graph comparable to FIG. 3, illustrating the operation of an electronic switch in dim mode according to the present invention.

FIG. 5 is a graph comparable to FIG. 4, illustrating the operation of an electronic switch in dim mode according to the present invention for use in the case of a capacitive ballast. Again, times t1 and t3 indicate zero crossings of the current, and time t2 indicates a switching moment when the switch S is closed. Time t4 is a switching moment when the switch S is opened again. The main difference with the prior art method of switching is that t4 is slightly later than t3.

The time period from time t2 to t4 will be indicated as the closing time interval CTI during which the switch S is continuously closed. This closing time interval CTI can be divided into a first closing time segment CTS1 before the zero crossing, having a duration Δ1=t3−t2, and a second closing time segment CTS2 after the zero crossing, having a duration Δ2=t4−t3. In other words, while in the prior art the closing time interval CTI extends entirely between two successive zero-crossings (and is bordered by one zero-crossing), the closing time interval CTI according to the present invention is shifted so that it extends on opposite sides of one zero-crossing.

In the following, the results will be discussed of some experiments, where the durations Δ1 and Δ2 of the closing times are indicated in unit time (milliseconds). In these experiments, a mains frequency of 50 Hz was used, corresponding to a current period of 20 ms. With reference to the above explanation, it should be clear that all durations Δ1 and Δ2 can be converted to phase durations θ1 and θ2 according to θ=Δ/T. It was found that, for different mains frequencies, the result of the experiments were similar or even identical if time durations Δ1 and Δ2 were adapted such that phase durations θ1 and θ2 remained constant.

Figure 6A:
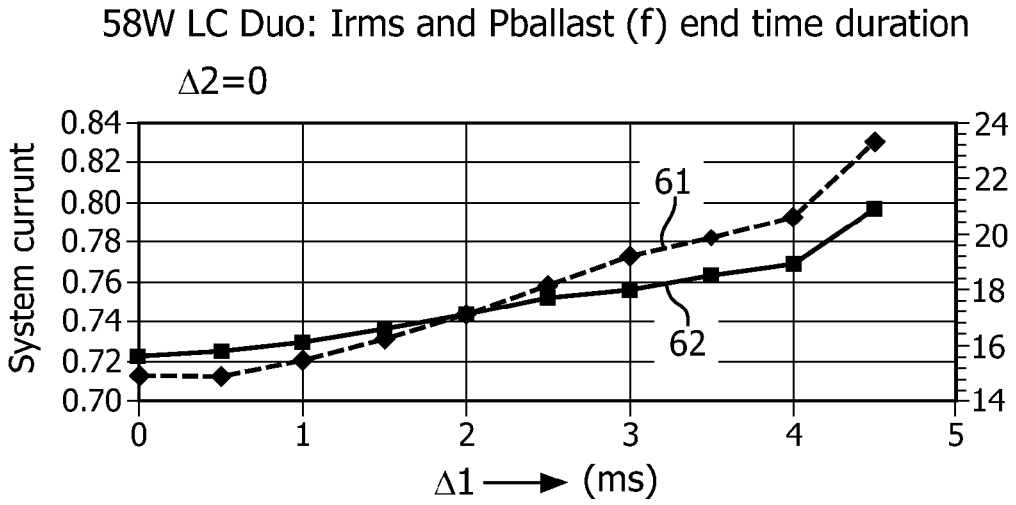
FIGS. 6A-6B are graphs illustrating the effect of dimming on power dissipation in the ballast.
Figure 6B:
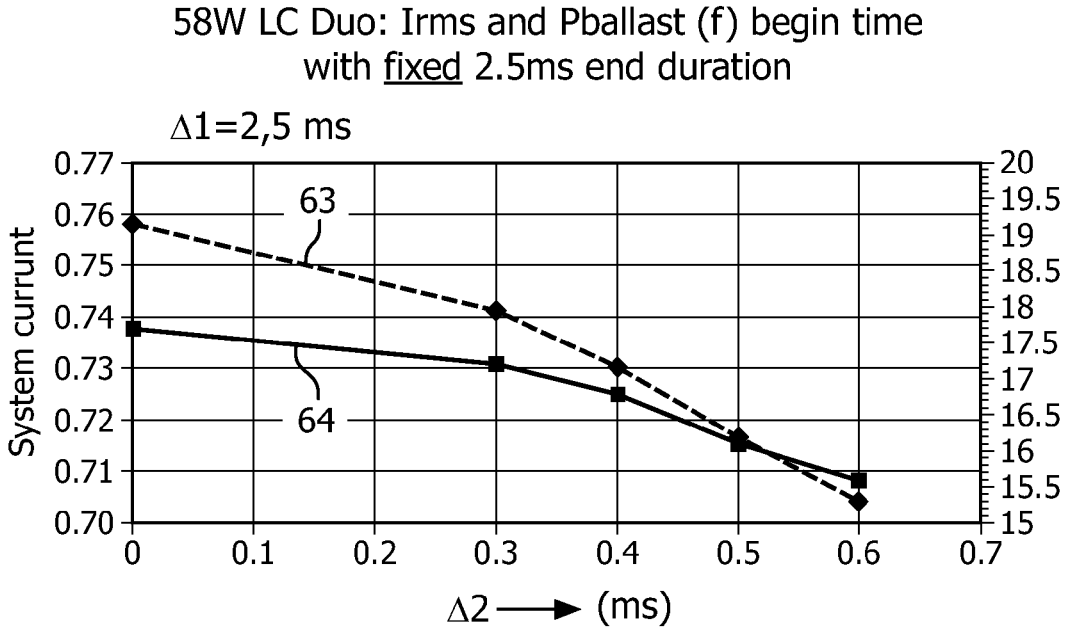

FIGS. 6A and 6B are graphs showing the influence of the first closing time segment CTS1 (FIG. 6A) and the second closing time segment CTS2 (FIG. 6B) on the system current ([Irms in ampere]; left hand axis) and the power dissipation in the ballast ([Watt]; right hand axis) as measured in a 58 W capacitive ballast. In FIG. 6A, the duration Δ2 of the second closing time segment CTS2 is selected to be equal to zero; increasing the duration Δ1 (horizontal axis, [ms]) from zero to 4.5 ms results in an increase in system current (curve 61) and an increase in power dissipation in the ballast (curve 62). In FIG. 6B, the duration Δ1 of the first closing time segment CTS1 is selected to be equal to 2.5 ms; increasing the duration Δ2 (horizontal axis, [ms]) from zero to 0.6 ms results in a reduction in system current (curve 63) and a reduction in power dissipation in the ballast (curve 64). Furthermore, the light output difference between the lamp with the inductive ballast and the lamp with the capacitive ballast will be limited. In a preferred embodiment, the dim level for the lamp with the inductive ballast will be about 70% and the dim level for the lamp with the capacitive ballast will be about 80%.

Varying the durations of the respective closing time segments CTS1 and CTS2 has influence on the power dissipation, the light output, and the noise generation, as will be discussed in the following with reference to FIGS. 7-10 which show the results of measurements performed on a TLD 36 W lamp.

Figure 7:
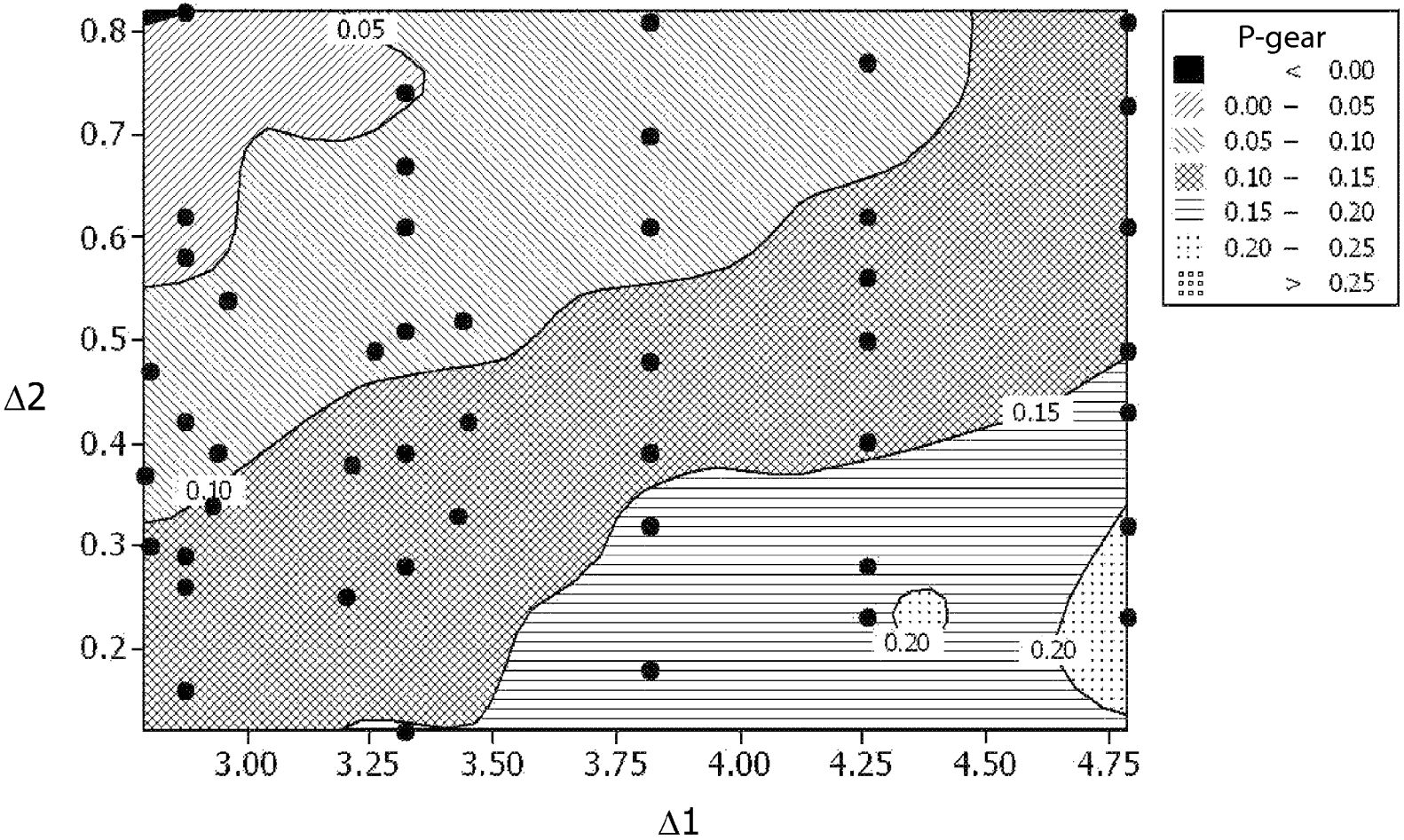
FIGS. 7-10 are contour graphs illustrating the influence of dimming behavior on certain lamp characteristics.

FIG. 7 is a contour plot showing the increase in power consumption [%] in the ballast as a function of the duration Δ1 of the first closing time segment CTS1 (horizontal axis, [ms]) and the duration Δ2 of the second closing time segment CTS2 (vertical axis, [ms]). It can be seen that, in general, an increase of Δ1 results in an increase of the power consumption while an increase of Δ2 results in a decrease of the power consumption. Based on these results, one would tend to keep Δ1 as low as possible and to select Δ2 as high as possible.

Figure 8:
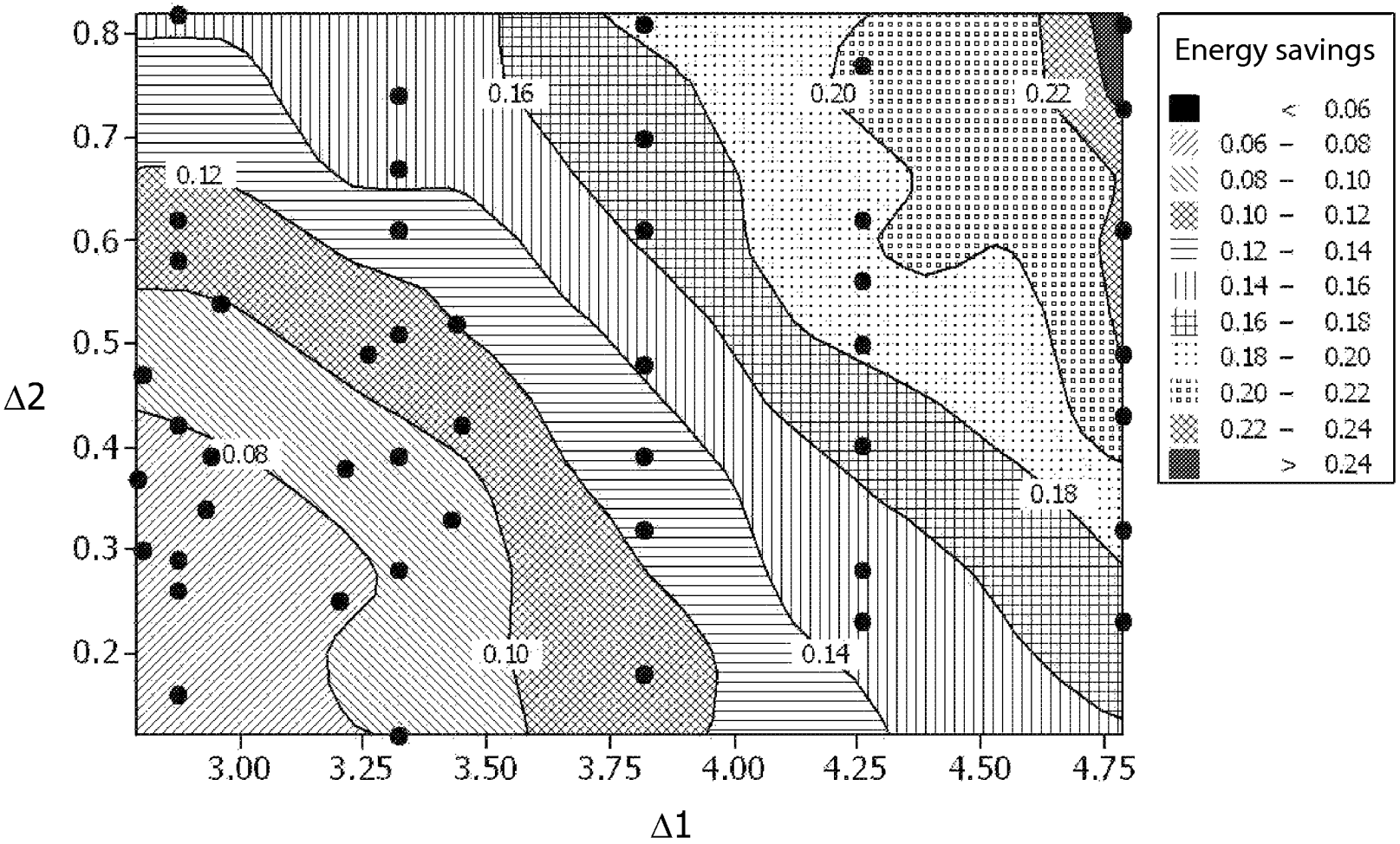

FIG. 8 is a contour plot showing the increase in energy saving [%] in the lamp with the capacitive ballast as a function of the duration Δ1 of the first closing time segment CTS1 (horizontal axis, [ms]) and the duration Δ2 of the second closing time segment CTS2 (vertical axis, [ms]). It can be seen that, in general, an increase of Δ1 results in an increase of the energy saving while an increase of Δ2 also results in an increase of the energy saving. Based on these results, one would tend to select Δ1 as high as possible and to select Δ2 as high as possible.

Figure 9:
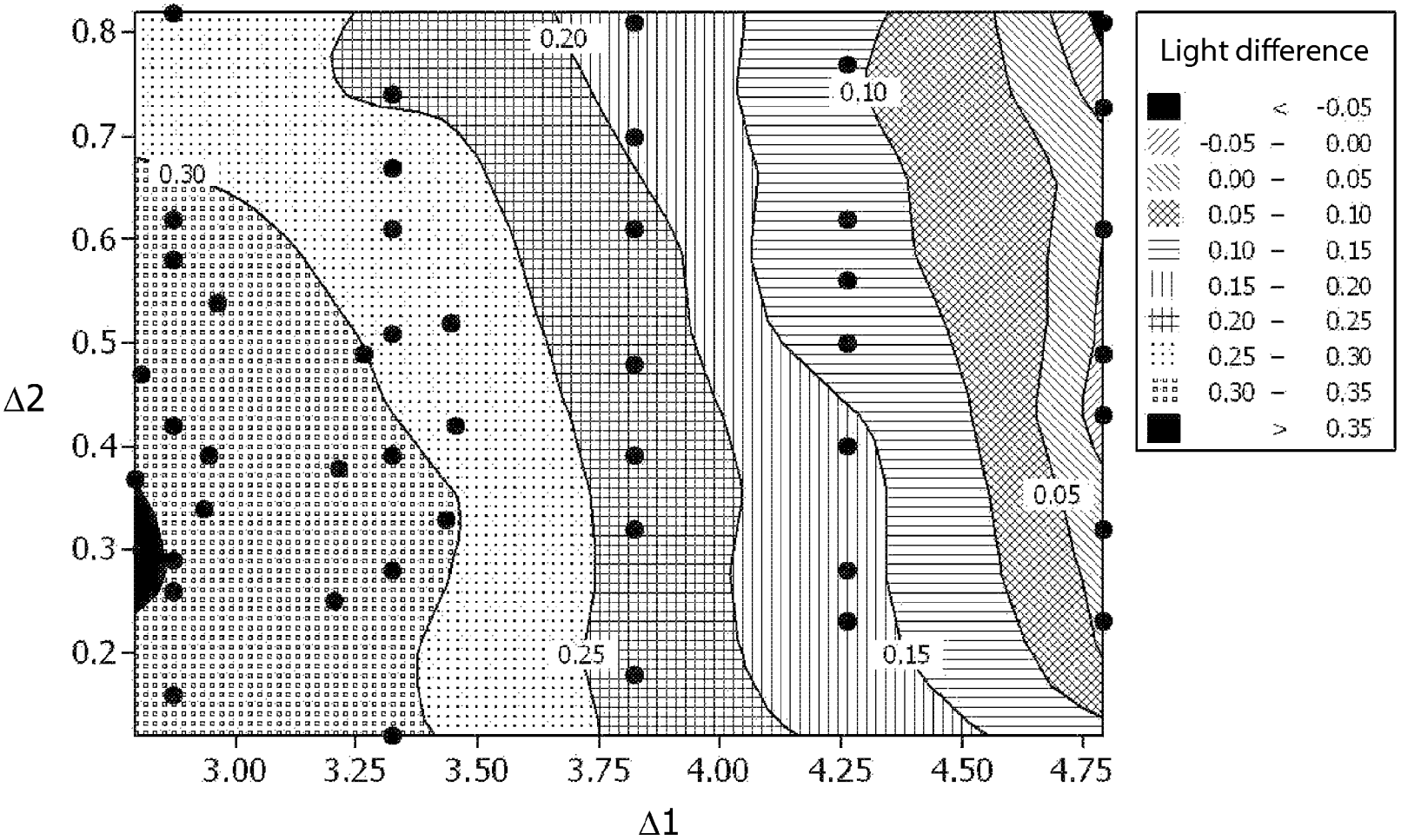

FIG. 9 is a contour plot showing the difference in light output [%] between a capacitively ballasted lamp and an inductively ballasted lamp in a duo armature as a function of the duration Δ1 of the first closing time segment CTS1 (horizontal axis, [ms]) and the duration Δ2 of the second closing time segment CTS2 (vertical axis, [ms]). It can be seen that, in general, an increase of Δ1 results in a decrease of the light output difference while Δ2 does not have much influence. Based on these results, one would tend to select Δ1 as high as possible without any preference for Δ2.

Figure 10:
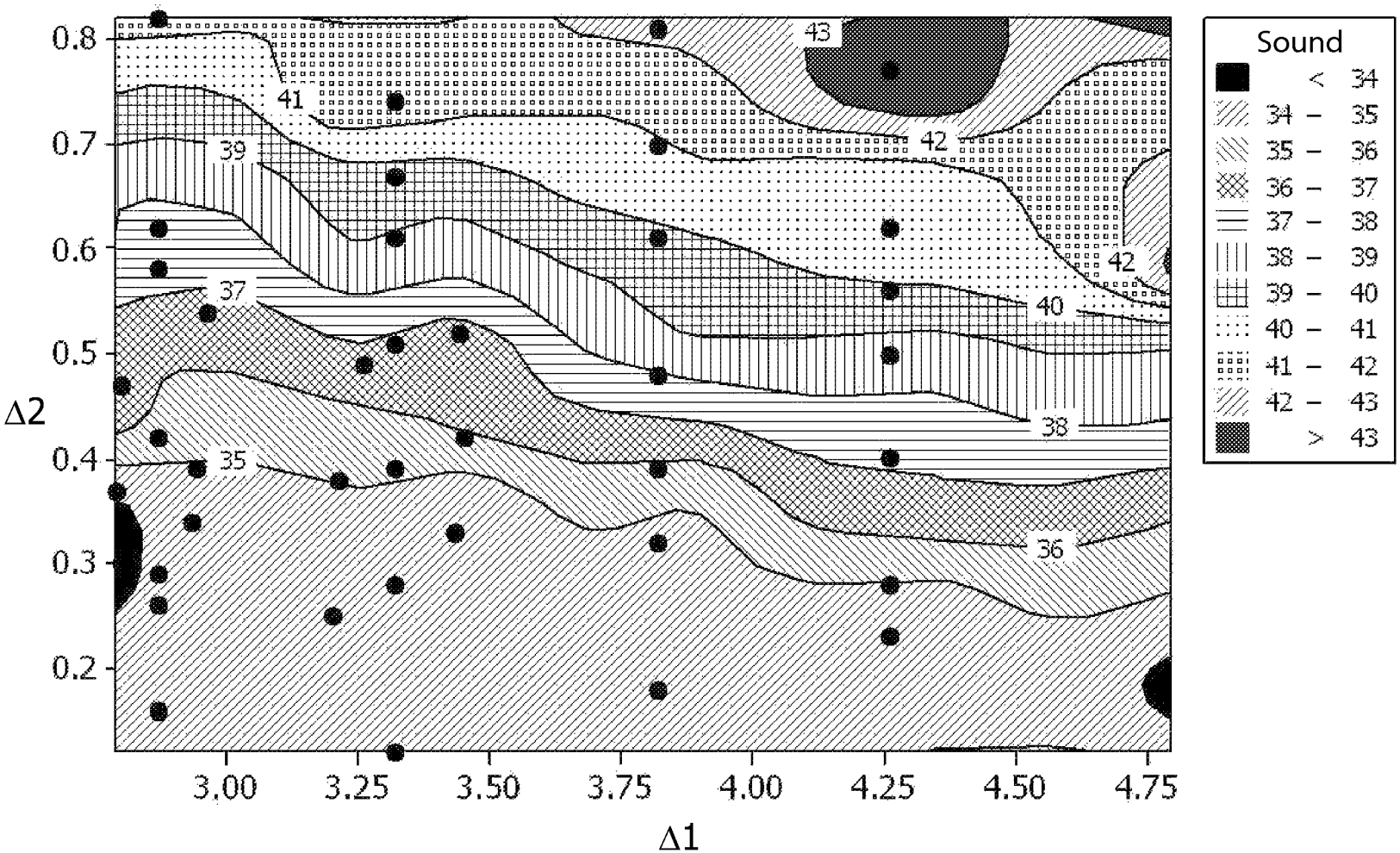

FIG. 10 is a contour plot showing noise level [dBa] of a capacitively ballasted lamp as a function of the duration Δ1 of the first closing time segment CTS1 (horizontal axis, [ms]) and the duration Δ2 of the second closing time segment CTS2 (vertical axis, [ms]). It can be seen that, in general, an increase of Δ2 results in an increase of the noise level while Δ1 does not have much influence, albeit that an increase of Δ1 tends to slightly increase the noise level. Based on these results, one would tend to select Δ2 as low as possible without any strong preference for Δ1.

Similar experiments have been conducted on other specimens of lamps of the same type. It was found that the measurement results are in good agreement with each other, although individual variations were found.

Further, similar experiments have been conducted on lamps of other type. While the general tendency could be recognized to be similar to the tendencies discussed above, the precise shapes of the contours and the precise values of the parameters will typically depend on lamp type.

Selecting operating values for Δ1 and Δ2 can be done on the basis of several considerations. One may perform optimizations for specific lamp types, resulting in dimmable electronic starters per lamp type. One may also wish to provide one general starter suitable for all lamp types. Further, the result will be a compromise between several design considerations, and will depend on the relative weights of the different design considerations.

For instance, noise is important. A design consideration may be that the noise should be less than 35 dBA. In that case, on the basis of FIG. 10, for this specific lamp type, one may decide that Δ2 should be less than 0.35 ms (θ2<0.0175).

Also, safety is important. This means that temperature should be limited, in other words that power dissipation in the ballast should not be too high. A design consideration may be that the increase in power dissipation should be less than 15%. In that case, on the basis of FIG. 7, for this specific lamp type, one may decide that Δ1 should be less than 3.50 ms (θ1<0.175).

One would like to achieve some energy saving, the more the better. Therefore, on the basis of FIG. 8, for this specific lamp type, one may decide that Δ1 should be higher than 3.25 ms (θ1>0.162), to achieve a saving of at least 8%.

If a somewhat higher noise level would be acceptable (and this depends on ambient conditions at the location where the lamp is used, and perhaps on sound-reducing properties of a luminaire), one may decide, on the basis of FIG. 10, for this specific lamp type, that Δ2 should be less than 0.5 ms (θ2<0.025). This offers some more freedom for selecting the other parameters. For instance, on the basis of FIG. 7, for this specific lamp type, one may decide that Δ2 should be higher than 0.35 ms (θ2>0.0175) and that Δ1 should be less than 4.5 ms (θ1<0.225). In such case, when setting Δ1 higher than 3.25 ms (θ1>0.162), the energy savings are already better than in the previous example, but one may even decide to select Δ1 higher than 3.75 ms (θ1>0.187) to achieve a saving of at least 12%. It is noted that, simultaneously, the light difference has improved, as can be seen from FIG. 9.

Summarizing, the present invention provides a method for operating a fluorescent lamp 5 having a nominal power WLa and stabilized with an EM ballast B. The method comprises the steps of, during normal operation, short-circuiting the lamp during a closing time interval CTI during each current period in order to operate the lamp at a reduced power.

The method comprises the step of detecting whether the lamp is stabilized by means of an inductive ballast or by means of a capacitive ballast. If it is found that the ballast is capacitive, the timing of the closing time interval CTI is set such that the closing time interval CTI has a first closing time segment CTS1 immediately before a zero-crossing of the current, having a first duration Δ1 higher than zero, and a second closing time segment CTS2 immediately after said zero-crossing of the current, having a second duration Δ2 higher than zero.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims. For instance, instead of a separate electronic starter device, it is also possible to implement the invention in a driver device with a capacitive ballast. In such case, it is not necessary to detect whether or not the ballast is capacitive.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. Method for operating a fluorescent lamp having a nominal power (WLa) and stabilized with an EM ballast (B) and supplied with a supply power comprising a supply voltage and supply current with current frequency (f) and current period (T), the method comprising the steps of, after starting and during normal operation, short-circuiting the lamp during an uninterrupted closing time interval (CTI) during each current period in order to operate the lamp at a reduced power, the method further comprising the steps of:

detecting whether the lamp is stabilized by means of an inductive ballast in an L-system or stabilized by means of a capacitive ballast in an LC-system;

if it is found that the lamp is stabilized by means of an inductive ballast in an L-system, setting the timing of the closing time interval (CTI) such that the closing time interval (CTI) is located entirely between two successive zero-crossings of the current; or if it is found that the lamp is stabilized by means of a capacitive ballast in an LC-system, setting the timing of the closing time interval (CTI) such that the closing time interval (CTI) has a first closing time segment (CTS1) immediately before a zero-crossing of the current, having a first duration (Δ1) higher than zero, and a second closing time segment (CTS2) immediately after said zero-crossing of the current, having a second duration (Δ2) higher than zero.

2. Method according to claim 1, wherein the first duration (Δ1) corresponds to a phase duration (θ1) selected in the range from about 0.125 to about 0.225, more preferably in the range from about 0.125 to about 0.175, more preferably about equal to 0.16; and, wherein the second duration (Δ2) corresponds to a phase duration (θ2) selected in the range from about 0.01 to about 0.04, more preferably in the range from about 0.01 to about 0.025, more preferably about equal to 0.0125.

3. Adaptive starter device, designed for being connected in parallel to a fluorescent lamp having a nominal power (WLa) and stabilized with an EM ballast (B) and supplied with a supply power comprising a supply voltage and supply current with current frequency (f) and current period (T), the device being designed for executing the method of claim 1.

4. Driver for operating a fluorescent lamp having a nominal power (WLa), the driver comprising:

lamp output terminals for connecting to respective lamp electrodes (3*ab*, 4*ab*) of the lamp;

an EM ballast (B) connected in series with at least one lamp output terminal, the EM ballast (B) comprising a series arrangement of an inductor (L) and a capacitor (C);

an electronic switch (S) connected in parallel to said lamp output terminals;

a control circuit for controlling the electronic switch;

wherein the control circuit is designed, after starting and during normal operation, to control the electronic switch (S) such as to short-circuit the lamp during an uninterrupted closing time interval (CTI) during each current period in order to operate the lamp at a reduced power, wherein the timing of the closing time interval (CTI) is such that the closing time interval (CTI) has a first closing time segment (CTS1) immediately before a zero-crossing of the current, having a first duration (Δ1) higher than zero, and a second closing time segment (CTS2) immediately after said zero-crossing of the current, having a second duration (Δ2) higher than zero.

5. Driver according to claim 4, wherein the first duration (Δ1) corresponds to a phase duration (θ1) selected in the range from about 0.125 to about 0.225, more preferably in the range from about 0.125 to about 0.175, more preferably about equal to 0.16; and, wherein the second duration (Δ2) corresponds to a phase duration (θ2) selected in the range from about 0.01 to about 0.04, more preferably in the range from about 0.01 to about 0.025, more preferably about equal to 0.0125.

6. Lamp system, for accommodating two fluorescent lamps of mutually the same type, each lamp having a nominal power (WLa), the system comprising individual lamp drivers for each lamp, each driver comprising:

lamp output terminals for connecting to respective lamp electrodes (3*ab*, 4*ab*) of the corresponding lamp;

an EM ballast (B) connected in series with at least one lamp output terminal, each ballast (B) comprising an inductor (L);

an electronic switch (S) connected in parallel to said lamp output terminals;

a control circuit for controlling the electronic switch;

wherein a first one of said ballasts is a substantially capacitive ballast comprising a series arrangement of said inductor (L) and a capacitor (C);

wherein the control circuit associated with this first ballast is designed, after starting and during normal operation, to control the corresponding electronic switch (S) such as to short-circuit the lamp during an uninterrupted closing time interval (CTI) during each current period in order to operate the lamp at a reduced power, wherein the timing of the closing time interval (CTI) is such that the closing time interval (CTI) has a first closing time segment (CTS1) immediately before a zero-crossing of the current, having a first duration (Δ1) higher than zero, and a second closing time segment (CTS2) immediately after said zero-crossing of the current, having a second duration (Δ2) higher than zero;

wherein a second one of said ballasts is a substantially inductive ballast;

wherein the control circuit associated with this second ballast is designed, after starting and during normal operation, to control the corresponding electronic switch (S) such as to short-circuit the lamp during an uninterrupted closing time interval (CTI) during each current period in order to operate the lamp at a reduced power, wherein the timing of the closing time interval (CTI) is such that the closing time interval (CTI) is located entirely between two successive zero-crossings of the current at terminates at such zero-crossing.

* * * * *